United States Patent [19]

Bryan

[11] Patent Number: 5,014,888

[45] Date of Patent: May 14, 1991

[54] CLOSURE FOR A CONTAINER

[76] Inventor: William T. Bryan, 927 Garnoa Dr., Cincinnati, Ohio 45231

[21] Appl. No.: 357,406

[22] Filed: May 26, 1989

[51] Int. Cl.[5] ..... B65D 47/10

[52] U.S. Cl. ..... 222/541; 222/572; 222/573; 222/574; 229/125.04; 229/125.08; 229/125.33; 229/125.15; 229/125.21; 229/125.26

[58] Field of Search ..... 222/541, 566, 572, 573, 222/574; 229/125.01, 125.04, 125.08, 125.33, 122, 124, 125, 125.13, 125.15, 125.21, 125.26, 127

[56] References Cited

U.S. PATENT DOCUMENTS 2,546,052 3/1951 Wilkins ..... 229/125.04 X 3,484,034 12/1969 Sternau ..... 229/125.04 X

*Primary Examiner*—David H. Bollinger

*Attorney, Agent, or Firm*—Roy F. Schaeperklaus

[57] ABSTRACT

A pour spout assembly for a container having major and minor chambers, a tongue formed from the wall of the minor chamber and hinged to the wall, the tongue being defined by a transverse and downwardly extending upright slittable lines of weakening in said wall at opposite ends of the transverse slittable line of weakening, the tongue being hinged to the wall at lower ends of the upright slittable lines of weakening, a web member having a central portion attached to an inner face of the tongue and having at least one portion thereof projecting across a slittable line of weakening and engageable with an inward facing face of the wall, outer glue panels attached to an inner face of the container adjacent the tongue and accordian pleat panels connecting the central portion and the outer glue panels, free edges of the central panel of the web being hinged to the accordian pleat panels, outer edges of the accordian pleat panels being hinged to the glue panels, the tongue swinging between a closed position in which the tongue is aligned with the wall and a portion of the central portion of the web overlaps a portion of the inward face of the wall adjacent the tongue and covers and closes a portion of a slit and an open position in which the tongue extends upwardly and outwardly from hinging means of the tongue when the slittable line of weakening have been slit, the pour spout being closable by swinging the tongue from the open position past alignment with the wall to move the projecting portion of the central portion of the web into the container and then outwardly to closed position secured by abutment of the projecting portion with the inward face of the wall.

30 Claims, 4 Drawing Sheets

CLOSURE FOR A CONTAINER

This invention relates to an improved closure for a container which may be of a shape free of abnormal external projections as it moves in commerce to the consumer. More particularly, this invention relates to an improved reclosable pour spout from which edge flaps project for engaging the inward face of the container adjacent the lateral edges and free end edge of a pour spout opening when the pour spout is closed and, if desired, a container inner seal having edges sealed to the inner face of the container to form a pouring spout isolation ante-chamber between the main chamber of a container and the discharge port reclosable by the container pour spout, and which is tamper and shoplifter resistant because the initial opening of the spout alters the appearance of the container so shoppers can by visual inspection determine if the carton has been opened and its contents possibly tampered with, and so clerks can similarly determine that a carton has been opened and may contain other merchandise, viz., lipsticks, which may have been inserted through the opened spout by a shoplifter, and the condition of the inner seal can provide additional indication of tampering.

BACKGROUND OF THE INVENTION

The closure for a container of this application represents an improvement over the closure shown and claimed in my copending application, Ser. No. 07/222,850, filed Jul. 22, 1988, now U.S. Pat No. 4,953,781 issued Sept. 4, 1990.

An object of this invention is to provide a closure structure for a container which may be in the form of a carton in which a tongue portion of a wall panel of the carton cooperates with a web attached to the tongue portion and to the wall panel adjacent the tongue portion to form the closure.

A further object of this invention is to provide a carton having a closure structure which does not protrude from the surface of the carton, and because it does not so protrude from the carton, the carton may be processed and filled by conventional erection and filling machinery and conventionally loaded in shipping containers with minimized likelihood of damage of adjacent cartons in transit.

A further object of this invention is to provide a closure structure for a container which before opening by the consumer, as it moves in commerce, does not detract from the carton aesthetics, nor occupy valuable surface area of the carton where placing of graphics and copy is desirable.

A further object of this invention is to provide such a closure structure including pleated web portions which can move between a locked open position and a locked closed position.

A further object of this invention is to provide such a closure structure in which the web projects beyond the free end of the tongue and the pleated web portions project laterally of the tongue portion to engage the inwardly facing face of the wall panel between the edge of the tongue opening and the attaching of the web to the wall panel, to retain the tongue in closed position, the web being attached to the wall panel adjacent the base of the tongue and laterally of the portion of the wall engaged by the projecting flaps.

Another object of this invention is to provide an inner seal panel having edges sealed to the inward face of the container annularly of the pour spout and dividing the interior of the container into main and spout chambers, and also by its undamaged condition indicating that the contents of the main chamber have not been tampered with.

Another object of this invention is to provide an inner seal panel which bridges perforations and locations of slots, cuts or the like in the container wall associated with the tongue to exclude from the main chamber matter passing through the perforations or other non-impervious portions in the portion of the container wall panel spanned and overlain by the seal panel.

Another object of this invention is to provide a seal panel which gives improved anti-sifting character to the main chamber of the container.

Another object of this invention is to provide a pour spout of substantially the width of a carton wall panel.

Another object of this invention is to provide a seal panel which prevents material and/or migration of product ingredients from the main chamber into the spout chamber and thereby prevents material entering into the spaces between the outwardly facing surfaces of the pleated web from whence it would be ejected and scattered by the opening of the pleated web as it is expanded upon opening of the spout.

Another object of this invention is to provide a carton blank having a web member, which blank may be assembled, erected, filled and closed by machines capable of handling similar carton blanks lacking the pour spout and inner seal panel features of this invention.

An additional object of this invention is to provide a separate chamber inside the container for inclusion of instructions, coupons, or other objects which, upon opening of the pour spout, will be free of product and/or ingredients and immediately available for retrieval by the consumer before the main chamber is opened to access the goods packaged in the main chamber, thereby precluding the need to search through the product in the main chamber after the main chamber is opened and also precluding such items later bridging the discharge opening or otherwise obstructing the discharge of product from the main chamber to and through the package spout after both are opened.

Another object of this invention is to provide an inner seal panel barrier between goods packaged in the main chamber and a spout chamber having perforations in the container wall panel separated from the main chamber by the inner seal panel barrier which is a barrier to substances which may adversely affect product packaged in the container, viz. moisture vapor, carbon dioxide or other materials which might in the absence of the inner seal panel barrier migrate into the carton main chamber through pervious portions of the container board wall spanned by the inner seal panel.

A further object of this invention is to provide a container of the foregoing character formed of container board having a barrier to escape or migration of one or more ingredients of the contained product past the barrier, in the absence of which barrier such ingredient or ingredients would cause degradation of the structure and/or appearance of portions of the container on the side of the barrier remote from the contained product.

A further object of this invention is to provide a container of the foregoing character in which an inner seal panel barrier spans pervious portions of the container wall so as to provide a sealed container having a sealed inner barrier between product surrounded by said barrier and portions of the container on the opposite side of the barrier from the product, whereby escape or migration of substances from the contained product to portions of the container beyond the barrier is precluded.

A further object of this invention is to provide a container of the foregoing character formed of container board having a barrier to substances which may adversely affect product packaged in the container, viz. moisture vapor, carbon dioxide and other materials, which with an inner seal panel barrier spanning pervious portions of the container wall, provides a sealed container in which the need for a sealed inner barrier, such as a bag, is obviated.

A further object of this invention is to provide a container of the foregoing character formed of container board having a barrier to substances which may adversely affect product packaged in the container, viz. moisture vapor, carbon dioxide, other gas or materials, with an inner seal panel barrier spanning portions of the container wall having areas of pervious character through which moisture vapor, carbon dioxide or other gas or materials such as oils, greases, surfactants or other materials might migrate and dividing the interior of the container into two chambers, thereby providing a sealed container having a chamber in which the need for a sealed inner barrier, such as a bag, is obviated.

A further object of this invention is to provide a reclosable pour spout structure including pleated web formed flap portions which can move between a locked open position and a flap locked closed position.

A further object of the invention is to provide pleated web portions which form generally triangular flaps, portions of which project laterally beyond the side edges of the spout tongue to overlie the inward face of the wall panel adjacent the side edges of the tongue opening with the apses of the angles of the triangular flaps adjacent the fold line of the tongue being spaced the same as or more closely than the side edges of the spout tongue so as to provide more latitude in the registry of the web and spout tongue while maintaining the apses on or between the side edges of the spout tongue.

A further object of the invention is to provide triangular side flaps which project beyond the side edges of the spout tongue a distance related to the distance the portion of the flap is spaced from the spout tongue hinge line and the distance the adjacent portion of the spout tongue moves relative to the container wall as the spout tongue is swung about the tongue hinge line to substantially avoid portions of flaps wedging between the side edges of the tongue opening near the spout tongue hinge line where spout tongue movement is small.

A further object of the invention is to provide triangular side flaps which in spout closed position progressively from nil projection at the spout tongue hinge line lockingly project progressively further behind the container wall laterally of the spout tongue.

A further object of the invention is to provide a container having an inner seal panel that is accessible through the open spout for removal of a portion thereof to provide a dispensing aperture through which contents of the main chamber may be dispensed to and through the spout chamber and spout.

A further object of the invention is to provide an inner seal panel having grippable means extending into the spout chamber wherein it is accessible to the user, after the spout chamber is opened, for pulling outward to provide a predetermined opening in the inner seal panel for dispensing contents of the main chamber to and through the spout chamber and spout.

Another object of the invention is to provide a predetermined opening in the inner seal panel having substantially the same width as the spout tongue opening in the container wall or of a narrower width and having its lateral edges parallel and inwardly adjacent the lateral edges of the spout tongue opening in the container wall so the triangular flaps may be drawn through the spout tongue opening in the container wall by swinging the spout tongue into the container until the triangular web side flaps are advanced through the spout opening in the container wall so the triangular flaps may spread between the container wall laterally of the spout opening therein and portions of the web extending to web glue flaps secured to the container wall laterally beyond the spread of the triangular flaps so the web and the container wall embrace the triangular flaps and the end web flap is concurrently drawn through the spout tongue opening so as to project between the container side wall and the inner seal panel above the spout tongue opening to improve the resealing and locking of the container and securing of the spout tongue in coplanar relation with the container side wall after a discharge opening has been made in the inner seal panel.

Another object of the invention is to provide a predetermined opening in the inner seal panel having substantially the same width as the spout tongue opening in the container wall and having its lateral edges parallel and inwardly adjacent the lateral edges of the spout tongue opening in the container wall so the triangular flaps may be drawn through the spout tongue opening in the container wall by swinging the spout tongue into the container until the triangular web side flaps are advanced through the spout opening in the container wall so the triangular flaps may spread between the container wall laterally of the spout opening therein and portions of the web extending to web glue flaps secured to the container wall laterally beyond the spread of the triangular flaps so the web and the container wall embrace the triangular flaps, and the end web flap is concurrently drawn through the spout tongue opening, but not through the opening in the inner seal panel to project between the container side wall and the inner seal panel above the spout tongue opening and the inner seal panel contacting the side of the web opposite the side of the web in contact with the triangular flaps to urge the web toward the container wall and against the triangular flaps to improve the resealing and locking of the container and securing of the spout tongue in coplanar relation with the container side wall after a discharge opening has been made in the inner seal panel.

Another object of the invention is to provide a spout tongue opening in the container wall through which the triangular flaps may be drawn by swinging the spout tongue into the container until the triangular web side flaps are advanced through the spout opening in the container wall so the triangular flaps may spread between the container wall laterally of the spout opening therein and portions of the web extending to web glue flaps secured to the container wall laterally beyond the spread of the triangular flaps so the web and the container wall embrace the triangular flaps to improve the resealing and locking of the container and securing of the spout tongue in coplanar relation with the container side wall after a discharge opening has been made in the container wall.

A further object of the invention is to provide a tab hinged to the tongue adjacent the free end thereof and swingable to project outwardly, away from the web, for convenient grasping by a user to push the tongue to swing through the tongue opening in the wall to advance the web flaps into the spout chamber and then pull the tongue outward into flush relation to the container wall or from that relation into spout extended open position.

Folded web closures for spouts are shown in patents such as Lewin U.S. Pat No. 1,698,338, Martin et al. U.S. Pat No. 2,077,341, Marken U.S. Pat. No. 2,444,104, Hansen U.S. Pat No. 2,757,830, Petitto U.S. Pat No. 3,154,226, and Kurtz U.S. Pat No. 3,250,436. However, the structures are entirely different.

BRIEF STATEMENT OF THE INVENTION

Briefly, this invention provides a container having a reclosable pour spout provided in a side panel thereof. The side panel is provided with slots which define a pour spout tongue which is hinged at one end to the side panel and, until opened, may remain attached to the side panel at a location spaced from the hinged end to provide visible evidence that the pour spout had not been opened. A central portion of a closure web overlies and is attached to an inner face of the tongue with a free edge portion of the web projecting beyond the free end of the tongue. Free lateral edges of said central portion of the web are connected to accordian pleats along lateral fold lines diverging from adjacent ends overlying the end of the tongue hinged to the side panel and extending outwardly across the lateral edges of the tongue to ends outboard of the lateral edges of the tongue adjacent the free end thereof to provide substantially triangular flaps projecting sidewardly of the tongue. Glue panels connected to the lateral edges of the accordian pleats are attached to the inner face of the side panel at a greater distance from the slots defining the tongue than the triangular flaps extend laterally beyond the slots defining the lateral edges of the tongue. A free edge portion of the web can snap between a position inside of the container overlying the inward face of the container, and a position outside the container at which the closure is open. An inner seal may span the pour spout tongue and web and adjacent its entire periphery be attached in fixed relation to portions of the inward face of the container wall not overlapped by a projecting web formed flap portion of the spout. The inner seal may have a grippable portion projecting into the spout chamber which may be pulled to tear the inner seal to provide a port for discharge of contents of the main chamber to and through the spout chamber and dispensing spout when it is open.

The above and other objects and features of the invention will be apparent to those skilled in the art to which this invention pertains from the following detailed description and the drawings, in which:

BRIEF DESCRIPTION OF THE DRAWINGS

In the following detailed description and the drawings, like reference characters indicate like parts.

DESCRIPTION OF PRESENTLY PREFERRED EMBODIMENT

Figure 1:
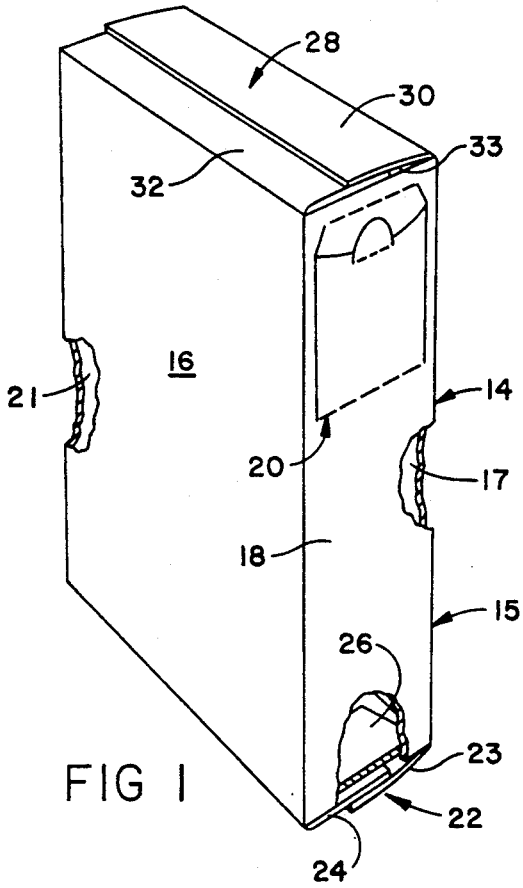
FIG. 1 is a view in perspective of a carton which includes a closure spout constructed in accordance with an embodiment of this invention, hinge lines being shown by dashed lines, portions of the carton being broken away to show details of construction.

FIG. 1 is shown a cardboard carton 14 constructed in accordance with an embodiment of this invention. The carton 14 includes a body 15, which may be generally on the form of a box for particulate material or the like. The carton 14 includes a front panel 16, a rear panel 17, which can be similar in form to the front panel, a first flat side panel 18, which carries a closure and spout assembly 20, and a second side panel 21, which can be generally similar to the first side panel. A bottom assembly 22 includes major flaps 23 and 24 hinged to the rear panel 17 and the front panel 16, respectively, and minor flaps 26, only one of which is shown. A top assembly 28 includes major flaps 30 and 32 and minor flaps 33, only one of which is shown.

Figure 3:
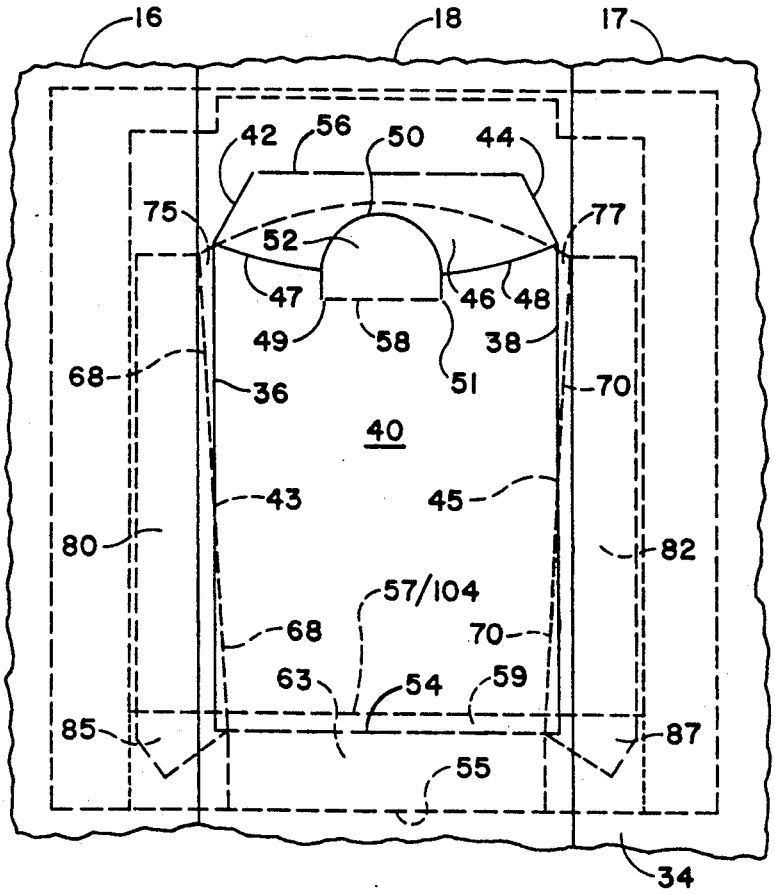
FIG. 3 is a fragmentary view in elevation of a blank for the carton in flattened condition with pour spout web and inner seal panel affixed in relation to the pour spout tongue and adjacent portions of the container.

The first side panel 18 is part of a blank 34, only a portion of which is shown in FIG. 3. Slits 36 and 38 separate the side edges of a main tongue 40 from the rest of the blank 34. If an upper tongue is also desired, slits 42 and 44 can separate the side edges of a short upper tongue 46 from the rest of the blank 34. A curved central slit 50 extends from end 49 to end 51 and separates the curved edge of tab 52 from contiguous parts of tongues 40 and 46. Cross slit segments 47 and 48 separate the end of tongue 40 from the carton wall, or, where an upper tongue 46 is provided, from tongue 46 laterally of tab 52, but tab 52, defined by the curved central slit 50, may be widened so its ends 49 and 51 respectively coincide with the point where slit 47 intersects slit 36 and the point where slit 48 intersects slit 38. The tongues 40 and 46 are provided with lines of weakening 54 and 56, respectively, which permit hinge-wise swinging of the tongues thereabout and, until opened, may remain attached to each other or the panel at a location spaced from the line(s) of their hinge-wise swinging. The tab 52 is provided with a line of weakening 58 which permits swinging of the tab 52. The slits 36 and 38 extend downwardly from end portions of the cross slit segments 47 and 48. The slits 42 and 44 extend upwardly from end portions of the cross slit segments 47 and 48.

Figure 5:
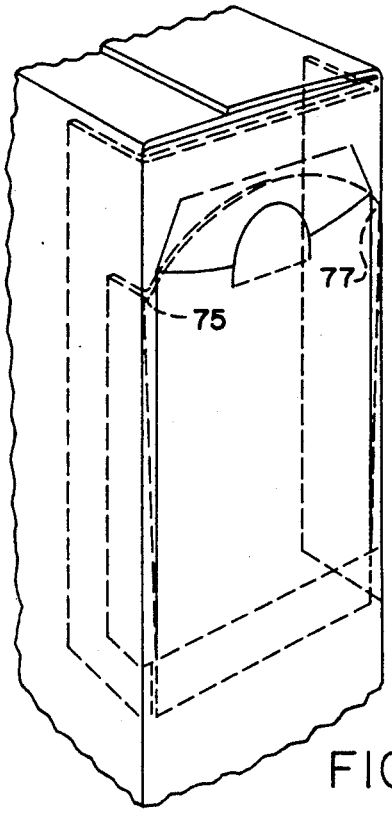
FIG. 5 is an enlarged view in perspective of the portion of the container which carries the closure and inner seal.
Figure 2:
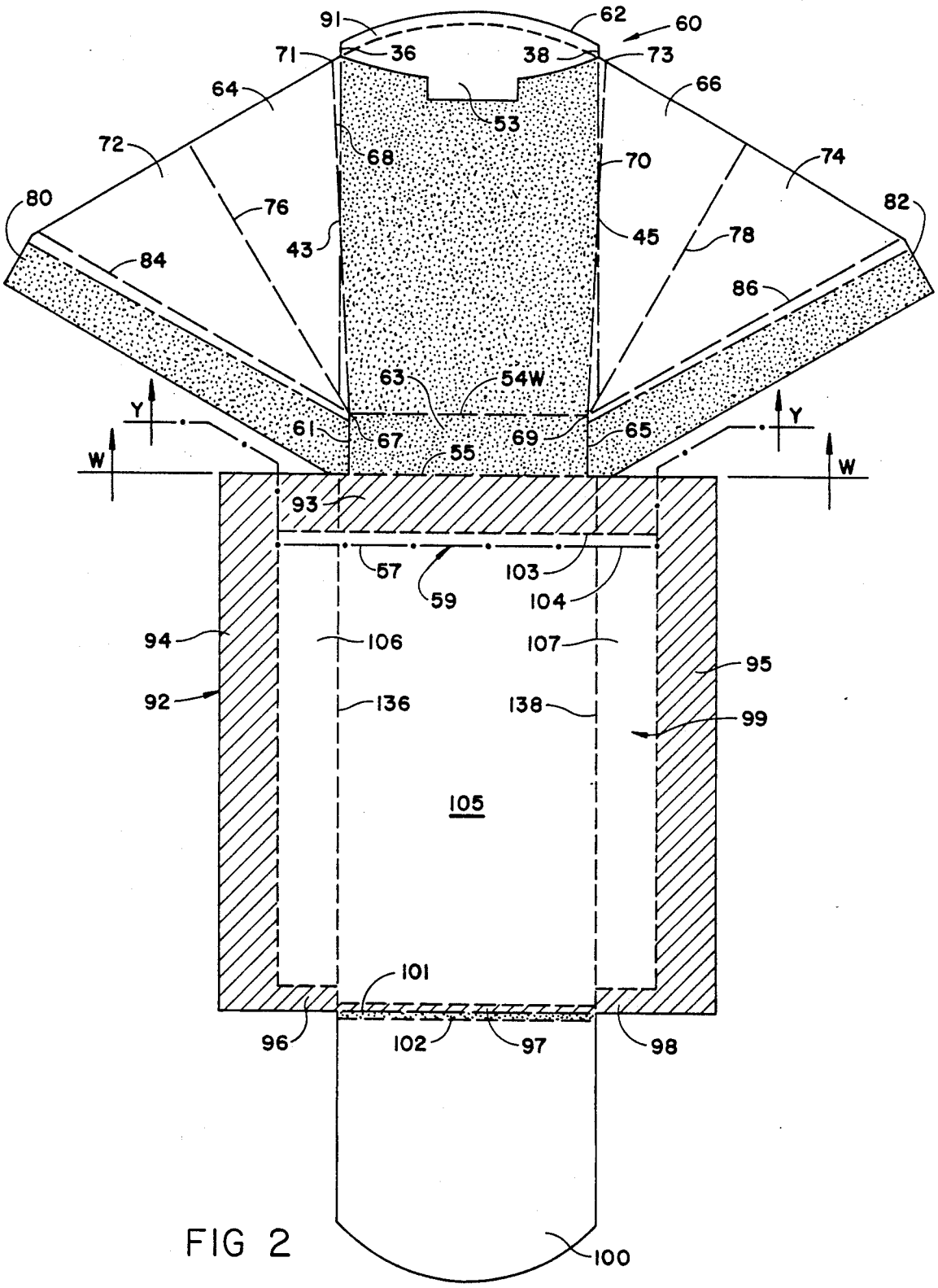
FIG. 2 is a plan view of a web member and inner seal panel assembly of the carton, glue coating on the near side being shown in stippling, glue coating on the far side being shown by dot-dash-line shading, and fold lines being shown in dashed lines.
Figure 4:
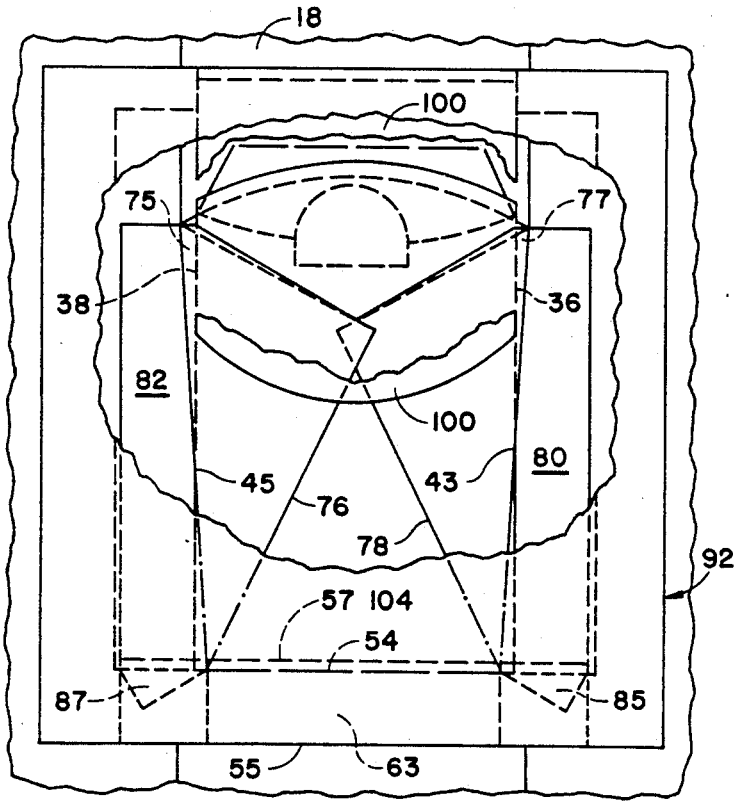
FIG. 4 is a fragmentary view of the carton blank and the web and inner seal panel (part of the latter being broken away) in attached position, hidden fold lines being shown in dot-dash lines.

The closure and spout assembly 20 is completed by a web member 60 shown in plan above line W—W in FIG. 2. The web member 60 includes a central panel 62, central wall glue panel 63, inner generally triangular first and second pleat panels 64 and 66 hinged to the central panel 62 along lines of fold 68 and 70, respectively, outer generally triangular third and fourth pleat panels 72 and 74, which are hinged to the first and second pleat panels at fold lines 76 and 78, respectively, and first and second glue panels 80 and 82, which are hinged to the third and fourth pleat panels 72 and 74 along fold lines 84 and 86, respectively. As indicated by stippling in FIG. 2, the central wall glue panel 63, first and second glue panel 80 and 82 and a major portion of the central panel 62 are areas of attachment of the web to the inward face of the container wall and are either provided with adhesive on their outer faces, or are secured by adhesive applied to the areas of the carton wall to which they are to be secured. As shown in FIG. 4, the first and third pleat panels 64 and 72 are folded together and the second and fourth pleat panels 66 and 74 are folded together. The inner face of the main tongue 40 is attached to the central panel 62 of the web member 60 by means of the adhesive on the central panel 62, but not to the inner face of tab 52, adhesive being omitted from the area 53 of panel 62 overlain by tab 52 and tongue 46. Central wall glue panel 63 extending from central plane 62 is secured by adhesive to the inwardly facing face of wall panel 18 below line 54 and web portions 62–63 reinforce the hinge line 54. The width of the central web panel 62 at the tongue hinge line 54 may be equal to or as shown may be less than the width of tongue 40 at hinge line 54, while the width of the central panel 62 adjacent the free end of the tongue 40 is wider than the tongue, so fold lines 68 and 70 extend from respective ends 67 and 69 at or inboard of the lateral edges 36, 38 of tongue 40 adjacent hinge line 54 and from or across lateral edges 36, 38 of tongue 40 to ends 71, 73 spaced outboard of the lateral edges of tongue 40 adjacent the free end of the tongue in an overlying relation to the inner or inward face of the box wall, viz. panel 18, laterally of the tongue opening when tongue 40 is coplanar with wall 18. Portions of panels 62 and 64 adjacent fold line 68 form a triangular flap 75 and portions of panels 66 and 62 adjacent fold line 70 form a triangular flap 77. Flaps 75 and 77 can flex and respectively project laterally of edges 36 and 38 of tongue 40 in underlying relation to the inwardly facing face of panel 18 when tongue 40 is coplanar with wall 18 as shown in FIGS. 3 and 5. As the tongue 40 is moved from closed coplanar relation with panel 18 to the open position in which it projects outward from that panel, the movement of the lateral edges of the tongue relative to panel 18 is least adjacent hinge line 54 and progressively greater to the free end of tongue 40 where the greatest movement occurs. The fold lines 68 and 70, when web 60 is secured to the tongue as described above, preferably have zero projection beyond the lateral edges of tongue 40 adjacent the hinge line of the tongue and the greatest projection laterally of the side edges of tongue 40 adjacent the free end of the tongue. The zero projection condition as shown in FIGS. 2, 3 and 4 may extend from hinge line 54 to points 43, 45 where fold lines 68, 70 cross side edges 36, 38 of tongue 40. The glue panels 80 and 82 are attached to underlying face portions of the first side panel 18, the front panel 16 and the rear panel 17 that are adjacent but spaced from portions of said panels which other portions, viz. flaps 75, 77, of web 60 can overlie.

Figure 6:
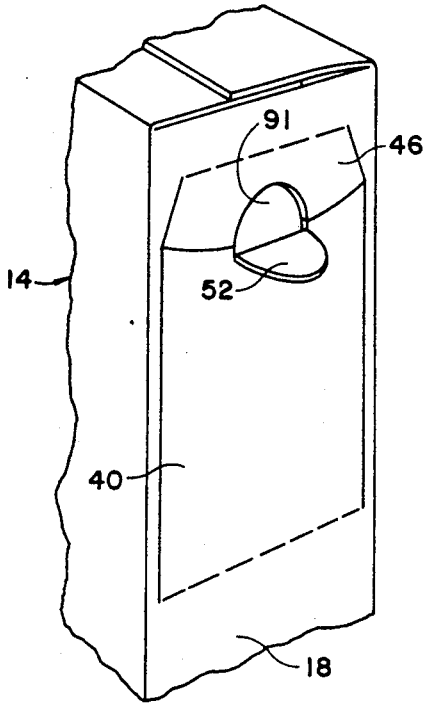
FIG. 6 is a fragmentary view in perspective of the container, a tab member being shown in extended position.
Figure 7:
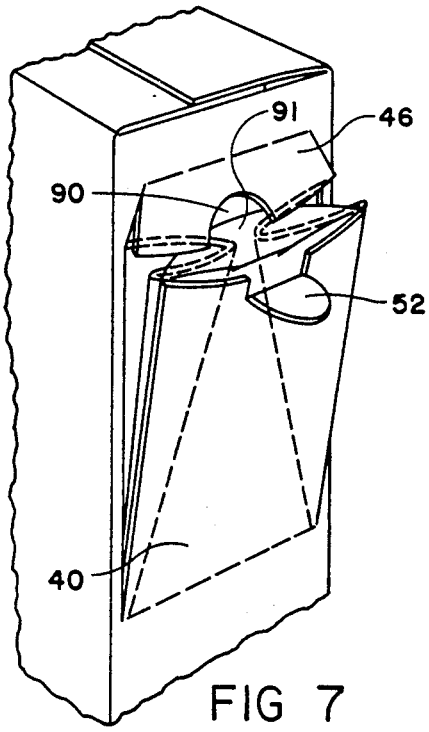
FIG. 7 is a fragmentary view in perspective of the closure portion of the container in partly open position.
Figure 8:
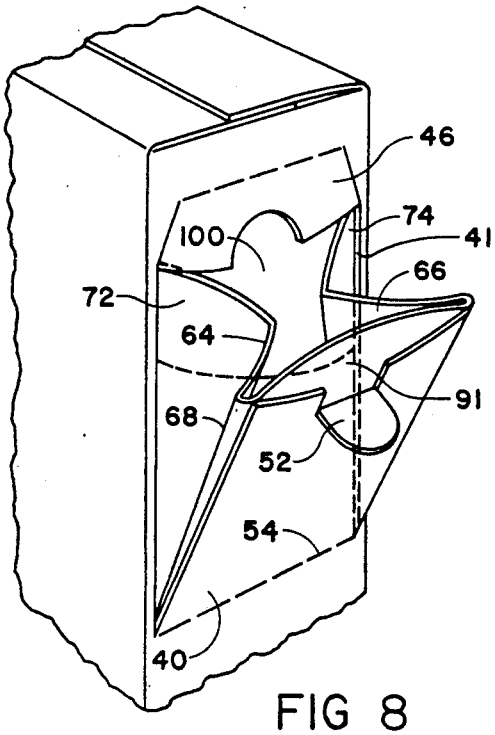
FIG. 8 is a view in perspective of the closure portion of the container with a closure in a near fully open but unlocked position.

The tab 52 can be swung out as shown in FIG. 6 and can be pulled outwardly of the carton 14 to cause tongue 40 to swing outwardly about hinge line 54 and draw triangular flaps 75, 77 from behing wall 18 and through the opening resulting from outward swinging of flap 40 about hinge line 54. Flaps 75 and 77 spread to project over the outward facing surface of panel 18 when they clear the edge of the wall opening. Outward swinging of tongue 40 causes an upper end portion 91 of the central panel 62 to be drawn trailingly through the opening, or to push the short upper tongue 46, if present, to swing outward and upward, out of the way as shown in FIG. 7 as the pleat panels open. The pleat panels can be opened toward fully open position as shown in FIG. 8. Finally, pairs of pleat panels 64–72 and 66–74 can be swung apart as shown in FIG. 9 to a locked position.

Figure 9:
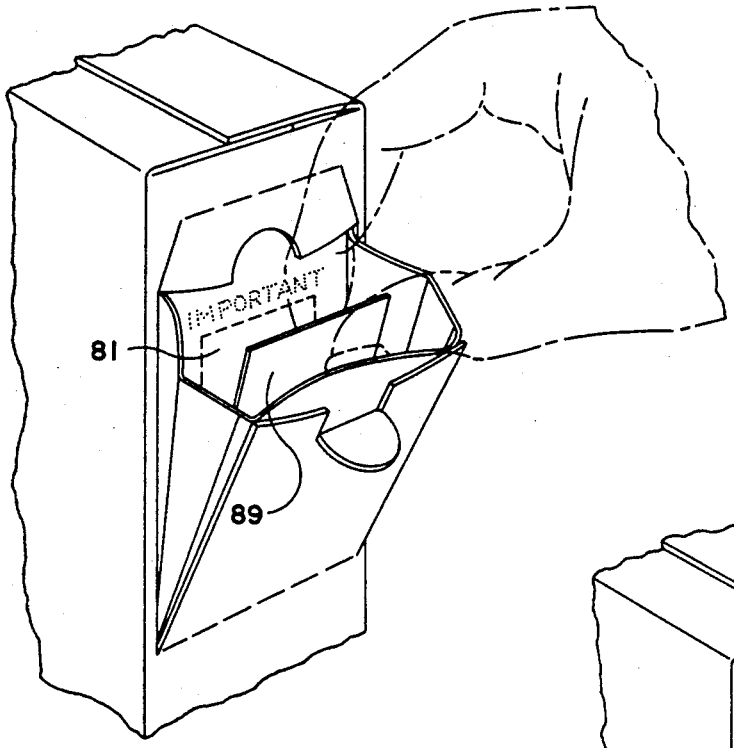
FIG. 9 is a view in perspective of the closure portion of the carton in open, locked position.
Figure 12:
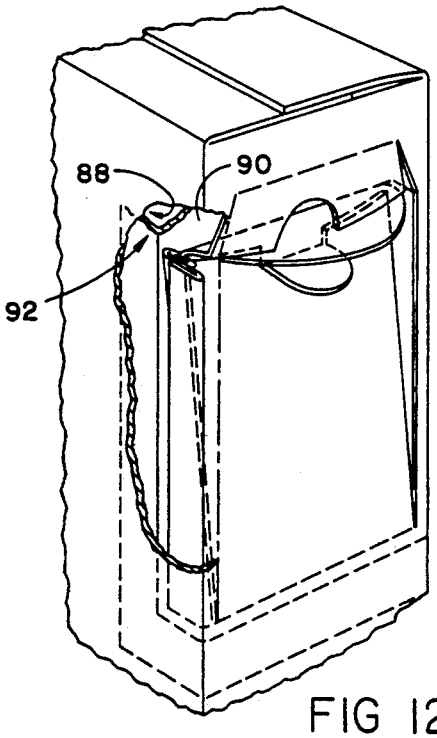
FIG. 12 is a fragmentary view in perspective of the closure portion of the carton in partly closed position in relation to a fragmentary portion of the inner seal panel.

When the closure assembly 20 is to be closed from the locked position of FIG. 9, the pairs of pleat panels 64–72 and 66–74 are returned to the position of FIG. 8 and the outwardly projecting tab 52 is grasped and pushed inwardly from the FIG. 8 position to bring the upper end portion 91 of the central panel 62 to bear against the container wall, or if the tongue 46 is present, to push the latter and the tongue 40 inwardly of the carton 14, as shown in FIG. 12. The tongue 46 is swung inwardly and upwardly as the upper end portion 91 folds downwardly as it passes trailingly beneath the lower edge of tongue 46 and then springs upward when it is inside of the box and behind the tongue 46, or in the absence of tongue 46, behind the box wall in position to, in response to pulling on tab 52, apply force directed from inside the container outwardly against tongue 46, if present, to bring the carton back to the FIG. 6 position at which the upper end portion 91 underlies and closes the cross slit 47–48 and bridgingly closes the opening left by forming of tongue 52. Also, as tab 52 is so manipulated, the triangular flaps 75, 77 trail against the lateral edges of the opening in wall 18 until they are clear to spread into positions underlying the inward facing face of wall 18, so that as tab 52 is pulled outwardly moving tongue 40 toward coplanar relation to wall 18, the flanges 75, 77 lie flatwise against the inwardly facing surface of wall 18. The tab 52 can be folded into alignment with the first side panel 18 for storage in the FIG. 1 position.

While slits 36, 38, 42, 44, 47, 48 and 50 referred to in the foregoing description are each shown in the drawings as continuous and extending through the container wall from end-to-end of the slit, the slits may be in the form of perforations or other wall weakening alterations of the wall so the consumer and vendor personnel may by observation visually verify the unopened condition of the container until the consumer has completed the slits, viz., by tearing, to open the carton and place it in condition for operation of the closure-spout.

Where desired, the web fold line 54*w* may be reinforced and improved sealing of the web to wall 18 attained in the vicinity of web fold line meeting points 67 (where fold lines 84, 76 and 71 meet) and 69 (where fold lines 86, 78 and 70 meet) respectively at the upper ends of cuts 61 and 65 defining the lateral edges of central wall glue panel 63. In the vicinity of points 67, 69, the folding of the web may result in some thickening effect on the web leading to a possiblity of leaking in the vicinity of points 67 and 69 when the glue does not completely seal any opening resulting from bulking by meeting folds in such areas of the web formed of the portion of the blank above line W—W in FIG. 2. Such reinforcement and sealing may be effected by revising the web blank to that portion of the blank above section line Y—Y in FIG. 2, thereby adding the supplemental seal panel 59 joined to central wall glue panel 63 along fold line 55. When the web is as above line Y—Y in FIG. 2 and is folded on fold line 55 so the seal panel 59 is folded inwardly and up so as to cover the inwardly facing face of the portions of the web below the line 57 in FIG. 3, and its entire face is glued in the position as shown in FIG. 3, that is the panel 59 spans hinge line 54*w*, also any aperture as might exist at and below points 67, 69 and outboard of edges 61, 65 of central wall glue panel 63 and also the lower portions 85, 87 of first and second glue panels 80, 82. Any portions of panel 59 extending beyond portions of the web above fold line 55 in FIG. 2 oppose portions of the inward facing face of wall 18 and are adhesively secured to that surface of side panel 18.

The interior of the carton 14 is divided by inner seal panel 92 into two chambers, a main chamber 88 and a spout chamber 90, as shown in FIG. 12. As shown in plan view below line W—W in FIG. 2, seal panel 92 may be rectangular in shape and integral with central wall glue panel 63 along fold line 55. If desired, the seal panel may have one or more barrier type selected layers provided by pattern printing or other methods, or the seal panel may be manufactured separately, of barrier type materials, and then joined with the spout web prior to the attachment to the carton blank. The far sides [as viewed in FIG. 2] of lateral margin areas 94, 95 and top margin areas 96, 97 and 98 are adhesively secured to portions of the inward face of the carton spaced from portions of that face which may be overlain by portions of the web member 60, while the far side of bottom margin area 93 is adhesively secured in face-to-face relation to the far side of the web from and below line 54 in FIG. 3, namely, the far sides of central wall glue panel 63 and the lower portions of the first and second glue panels 80, 82 overlain by margin area 93, the near face of which portions of the web are adhesively secured to a portion of the inward face of the carton adjacent the portions to which first and second lateral glue areas 94, 95 are secured, so the central portion 99 of the seal panel 92 spans the spout structure and the contiguous inward wall area bounded by the surrounding adjacent area of attachment of glue panels 63, 93, 94, 95, 96, 97 and 98 and with the carton forms a spout chamber housing the spout structure in the container.

Figure 10:
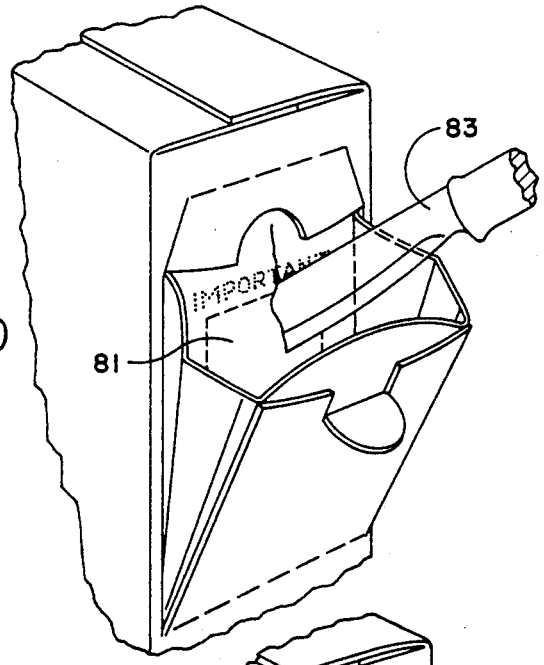
FIG. 10 is a view in a perspective view of the closure portion of the carton in open, locked position as the seal is broken.

As shown in FIGS. 9 and 10, when the spout 20 is opened, the inner seal 92 is unpunctured and undamaged condition evidences the fact that the main chamber 88 of the carton 14 has not been accessed through the spout chamber 90.

The spout chamber 90, when inner seal 92 is installed on the carton blank as described, provides a closed chamber 90 in which objects may be packed to travel to the consumer, objects such as coupons, tokens, proof of purchase devices, recipes or such other item 89 as the manufacturer may desire to immediately place in the hands of the consumer at the time the spout chamber 90 is opened, thus avoiding placing same in the product packaged in the main chamber 88 of the carton wherein the consumer would have to hunt for same, or from whence same might span or obstruct the main chamber discharge opening in the inner seal panel as contents of the main chamber are discharged toward the spout. The central portion of the inner seal may itself be an integral coupon 81 as an alternative for, or in addition to another important article 89 as illustrated in FIG. 9.

The inner seal as shown in FIG. 10 may be broken and opened as by piercing and cutting with a knife 83 or the like, or be provided with associated means for grasping and removing a central portion of the inner seal panel, such as 105, that substantially registers with the opening 41 in the wall 18 that is opened by swinging tongue 40 outward into open spout position.

Figure 11:
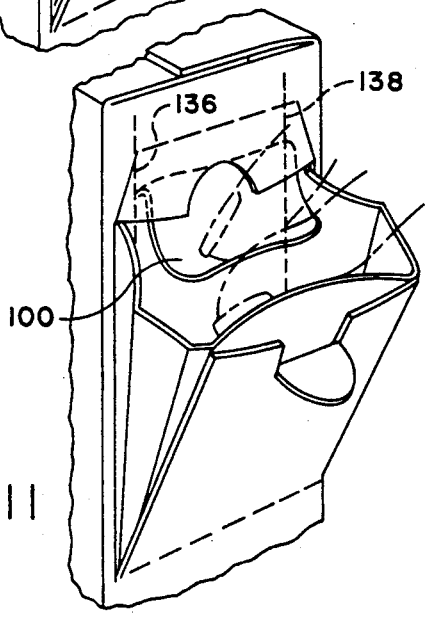
FIG. 11 is a view in perspective of the closure portion of the carton in open, locked position as the seal is broken by drawing a pull tab of the inner seal panel to open a predetermined discharge port in the inner seal panel.

The inner seal 92 may be provided with an opening tab 100 that extends integrally from the edge 101 of inner seal panel 92 as shown in FIG. 2. From the position shown in FIG. 2, opening tab 100 is folded into the page and up behind inner seal panel 92 about fold line 101. The far sides of areas 97 and 102 (as viewed in FIG. 2) will then be positioned for adhesive attachment in face-to-face relation to provide a reinforced portion 97–102 at the top end of inner seal panel portion 97. Opening tab 100 may have a width substantially equal to the width of the opening 41 in wall 18 when tongue 40 is swung outward, the width of which opening is indicated in FIG. 2 by the spacing of lines 136 and 138, which may be lines of weakening which facilitate tearing of the central portion 105 of panel 92 (between lines 136, 138) from laterally adjacent portions 106, 107 of panel 92, while portions 106, 107 are adjacent or against the inward face of wall 18, or 18 and 16 and 17, and glue panels 80, 82 overlying portions of carton 14 as opening tab 100 is gripped as shown in FIG. 11 and pulled outwardly to tear open the inner seal.

The composite web member -seal panel- opening tab assembly blank 60-92-100, whether an assembly of a plurality of parts, each fabricated from a respective material, or a unitary part fabricated from a single piece of material as shown in FIG. 2, may be prepared for affixation to the carton blank by folding triangular panel 64 about fold line 68 to lie flatwise against the far side of central panel 62 and between panel 62 and triangular panel 72 which extends from fold line 76 to first glue panel 80 projecting laterally of panel 62, by further folding triangular panel 66 about fold line 70 to lie flatwise against the far side of central panel 62 and between panel 62 and triangular panel 74 which extends from fold line 78 to second glue panel 82 projecting laterally of panel 62, by folding opening tab 100 to lie flatwise behind seal panel 92 and extending upward from the fold at edge 101, and by folding the seal panel 92 into the page and up behind the previously folded web elements so opening tab 100 will extend between the triangular panels 72, 74 and seal panel 92, or otherwise into the spout chamber formed by the container wall and the inner seal panel. The pre-folded composite web member -seal panel -opening tab assembly 60-92-100 with any associated object 89 desired to be included in the spout chamber inserted in the assembly, and, with adhesive pre-applied to the appropriate areas of either the assembly or the container, may then be affixed in proper relation to the dispensing spout location on the carton blank.

When the inner seal panel has been opened as by use of opening tab 100 so that it has a discharge opening through which contents of the main chamber may discharge into the spout chamber and out through the spout, the lateral edges of the discharge opening in the inner seal panel are essentially parallel and close spaced to the edges of the spout opening in wall 18 of the carton. When the open spout is closed by gripping tab 52 and pushing tongue 40 past coplanar relation with the carton wall 18 into the spout chamber far enough that the triangular flaps 75 and 77 and spout end flap 91 are drawn through the opening in wall 18 and spread to underlie the inward face of the carton wall, the tongue 40 is not pushed further to the extent that any of said flaps are pushed through the discharge opening in inner seal panel 92, with the result that as the tongue 40 is drawn outwardly into coplanar relation with the wall 18 of the carton, the mentioned flaps 75, 77 and 91 project between the carton wall and respective parts of panels 72, 74 near the respective glue panels 80, 82 respectively while being supported by the portions of the inner seal panel annularly of the opening therein, so as to provide a closure with enhanced anti-sifting character, as well as a closure of enhanced locking of the tongue and associated spout parts in closed relation to the carton wall 18 so as to provide enhanced resistance to migration of substances past the closure in the carton wall.

If desired, the web fold line **54*w* may be reinforced and improved sealing of the web to wall 18 attained in the vicinity of web fold line meeting points 67 (where fold lines 84, 76 and 71 meet) and 69 (where fold lines 86, 78 and 70 meet) respectively at the upper ends of cuts 61 and 65 defining the lateral edges of central wall glue panel 63. In the vicinity of points 67, 69, the folding of the web may result in some thickening effect on the web leading to a possibility of leaking in the vicinity of points 67 and 69 during discharge of contents of the main chamber through the spout when the glue does not completely seal any opening resulting from bulking by meeting folds in such areas of the web formed of the portion of the blank above line W—W in FIG. 2. Such reinforcement and sealing may be effected by revising the inner seal panel portion 92 of the blank, that is the portion of the blank below section line W—W in FIG. 2, by enlarging bottom margin glue area 92 to include the additional area between lines 103 and 104 in FIG. 2 so the bottom margin glue area 93 corresponds in vertical extent to that of supplemental seal panel 59 joined to central wall glue panel along fold line 55 described earlier. When bottom margin glue area 93 is so revised and inner seal panel 92 is folded inwardly and up so as to cover the inwardly facing face of the portions of the web above the line 55 in FIGS. 2 and 3, the bottom margin glue area 93 extends to line 57/104 in FIG. 3, spans hinge line 54*w*, also any aperture as might exist above line 55 and at and below points 67, 69 and outboard of edges 61, 65 of central wall glue panel 63 and also the lower portions 85, 87 of first and second glue panels 80, 82. Any portions of area 93 extending beyond portions of the web above fold line 55 in FIG. 3, oppose portions of the inward facing face of wall 18 and are adhesively secured to that surface of side panel 18**.

The container/carton closure construction illustrated in the drawings and described above is subject to structural modification without departing from the spirit and scope of the appended claims.

Having described my invention, what I claim as new and desire to secure by letters patent is:

1. A pour spout assembly for a container having a wall which comprises a tongue formed from the wall and hinged to the wall, the tongue being defined by a transverse slittable line of weakening in said wall and downwardly extending upright slittable lines of weakening in said wall at opposite ends of the transverse slittable line of weakening, the tongue being hinged to the wall at lower ends of the upright slittable lines of weakening, a web member having a central portion attached to an inner face of the tongue, outer glue panels attached to an inner face of the container adjacent the tongue and accordian pleat panels connecting the central portion and the outer glue panels, free edges of the central panel of the web being hinged to the accordian pleat panels, outer edges of the accordian pleat panels being hinged to the glue panels, the tongue swinging between a closed position in which the tongue is aligned with the wall and an upper portion of the central portion of the web overlaps a portion of the inward face of the wall above the tongue and covers and closes the transverse slit and an open position in which the tongue extends upwardly and outwardly from hinging means of the tongue when the slittable lines of weakening have been slit, the pour spout being closable by swinging the tongue from the open position past alignment with the wall to move the upper portion of the central portion of the web into the container and then outwardly to closed position secured by abutment of the upper portion of the central portion of the web with the inward face of the wall.

2. A pour spout assembly as in claim 1 in which there is a major chamber in the container and the major chamber is spaced from the minor chamber by an inner seal panel.

3. A pour spout assembly as in claim 2 in which the inner seal panel is readily frangible to permit access to the major chamber.

4. A pour spout assembly as in claim 3 in which the container and inner seal panel have like barrier properties to provide a major chamber for isolating product contained therein from contact with predetermined substance outside the major chamber.

5. A pour spout assembly as in claim 1 in which a web seal panel overlaps the central web portion, the accordian fold portions, the glue panels and the inward face of the wall adjacent an end of the tongue hinge line to spanningly close and to effect a seal to preclude escape of product from the pour spout adjacent the ends of the tongue hinge line.

6. A pour spout assembly as in claim 1 having an inner seal panel attached to the inward face of the wall annularly of the tongue and accordian pleat panels and underlying the tongue and web portions to form a minor chamber between a portion of the in-facing side of the wall and tongue and the inner seal panel.

7. A pour spout assembly as in claim 6 wherein the accordian pleat panels overlie the central web portion, one pair of accordian pleat panels extend between the other pair of accordian pleat panels and the central web portion, and the other pair of accordian pleat panels extend between the first pair of accordian pleat panels and the seal panel, the accordian pleat panels and the central web portion being adapted to confine articles enclosed in the minor chamber in desired position.

8. A pour spout assembly as in claim 6 wherein the pairs of accordian pleat panels extend toward each other and between the central web portion and the seal panel, the accordian pleat panels and the central web portion being adapted to confine articles enclosed in the minor chamber in desired position.

9. A pour spout assembly as in claim 6 wherein the seal panel divides the container into major and minor chambers whereby articles enclosed in the minor chamber are isolated from the contents of the major chamber and readily accessible to the consumer upon opening of the pour spout while the major chamber remains unopened.

10. A pour spout assembly as in claim 9 in which the container and inner seal panel have like barrier properties and provide the major chamber surrounded by a barrier isolating product contained in the major chamber from the contact with predetermined substance outside the major chamber.

11. A pour spout assembly as in claim 10 in which the container and inner seal panel have like barrier properties and isolate the contents of the major chamber from the surrounding environment and preclude escape of any part of the predetermined content of the major chamber.

12. A pour spout assembly as in claim 1 wherein at least one of the slits defining the tongue is incomplete and must be completed to open the pour spout to provide a visible indication that the container has been opened and the contents thereof may have been tampered with or may have been supplemented by a shoplifter whereby the purchaser and the merchant may be alerted at the time of purchase.

13. A pour spout assembly for a container having a wall which comprises a tongue formed from the wall and hinged to the wall, the tongue being defined by a transverse slittable line of weakening in said wall and downwardly extending upright slittable lines of weakening in said wall at opposite ends of the transverse slittable line of weakening, the tongue being hinged to the wall at lower ends of the upright slittable lines of weakening, a web member having a central portion attached to an inner face of the tongue, outer glue panels attached to an inner face of the container adjacent the tongue and accordian pleat panels connecting the central portion and the outer glue panels, free edges of the central panel of the web being hinged to the accordian pleat panels, outer edges of the accordian pleat panels being hinged to the glue panels, the tongue swinging between a closed position in which the tongue is aligned with the wall and an upper portion of the central portion of the web overlaps a portion of the inward face of the wall above the tongue and covers and closes the transverse slit and an open position in which the tongue extends upwardly and outwardly from hinging means of the tongue when the slittable lines of weakening have been slit, the pour spout being closable by swinging the tongue from the open position past alignment with the wall to move the upper portion of the central portion of the web into the container and then outwardly to closed position secured by abutment with the inward face of the wall and in which the central portion of the web being wider than the tongue adjacent the transverse slit and no wider than the tongue where hinged to the wall, at least a portion of the central web portion spanning a portion of an upright slit and overlapping a portion of the inward face of the wall between the slit and a glue panel to resist movement of the spout from closed to open position.

14. A pour spout assembly as in claim 13 in which a central wall glue panel portion of the web is secured to the inward face of the wall and reinforces the wall and tongue hinge.

15. A pour spout assembly as in claim 14 wherein a seal panel divides the container into major and minor chambers whereby articles enclosed in the minor chamber are isolated from the contents of the major chamber and readily accessible to the consumer upon opening of the pour spout while the major chamber remains unopened whereby a container having a pour spout is provided which is erectable and fillable by conventional carton filling machinery, has an exterior surface free of protrusions to minimize in-transit damage to it and adjacent containers and is insertable in shipping containers in the usual manner.

16. A pour spout assembly for a container having a wall which comprises a tongue formed from the wall and hinged to the wall, the tongue being defined by a transverse slittable line of weakening in said wall and downwardly extending upright slittable lines of weakening in said wall at opposite ends of the transverse slittable line of weakening, the tongue being hinged to the wall at lower ends of the upright slittable lines of weakening, a web member having a central portion, the central portion of the web is attached to an area of the inner face of the tongue, outer glue panels attached to an inner face of the container adjacent the tongue and accordian pleat panels connecting the central portion and the other glue panels, free edges of the central panel of the web being hinged to the accordian pleat panels, outer edges of the accordian pleat panels being hinged to the glue panels, the tongue being wider adjacent the tongue hinge line and narrower adjacent the free end of the tongue than the attached central portion of the web, the tongue swinging between a closed position in which the tongue is aligned with the wall and an upper portion of the central portion of the web overlaps a portion of the inward face of the wall above the tongue and covers and closes the transverse slit and an open position in which the tongue extends upwardly and outwardly from hinging means of the tongue when the slittable lines of weakening have been slit and determine the width and cross-sectional configuration of the mouth of the spout when the tongue is fully extended, the pour spout being closable by swinging the tongue from the open position past alignment with the wall to move the upper portion of the central portion of the web into the container and then outwardly to closed position secured by abutment with the inward face to the wall.

17. A pour spout assembly for a container having a wall which comprises a first tongue formed from the wall and hinged to the wall and a second tongue formed from the wall and hinged to the wall, the first tongue being defined by a transverse slit in said wall and downwardly extending upright slits in said wall at opposite ends of the transverse slit, the first tongue being hinged to the wall at lower ends of the upright slits, the second tongue being defined by said transverse slit and by upwardly extending slits at opposite ends of the transverse slit, the second tongue being hinged to the wall at upper ends of the upright slits of the second tongue, a web member having a central portion attached to an inner face of the first tongue, outer glue panels attached to an inner face of the container adjacent the first tongue, and accordian pleat planels connecting the central portion and the outer glue panels, free edges of the central panel of the web being hinged to the accordian pleat panels, outer edges of the accordian pleat panels being hinged to the glue panels, and an inner seal panel attached to the inside of the wall and underlying the tongues to form a minor chamber between a portion of the infacing side of the wall with the tongues and the inner seal panel, the first tongue swinging between a closed position in which the first tongue is aligned with the wall and an upper portion of the central portion of the web overlaps a portion of the inward face of the second tongue and covers and closes the transverse slit and an open position in which the first tongue extends upwardly and outwardly from hinging means of the first tongue, the interior of the chamber being exposed when the first tongue is in the open position.

18. A pour spout assembly for a container having a wall which comprises a tongue formed from the wall and hinged to the wall, the tongue being defined by a transverse parting line of weakening in said wall and downwardly extending upright slittable lines of weakening in said wall at opposite ends of the transverse parting line of weakening, the tongue being hinged to the wall at lower ends of the upright slittable lines of weakening, a web member having a central portion attached to an inner face of the tongue, outer glue panels attached to an inner face of the container adjacent the tongue and accordian pleat panels connecting the central portion and the outer glue panels, free edges of the central panel of the web being hinged to the accordian pleat panels, outer edges of the accordian pleat panels being hinged to the glue panels, and at least a portion of the central web portion spanning a portion of an upright slit and overlapping a portion of the inward face of the wall between the slit and a glue panel to resist movement of the spout from closed to open position, the tongue swinging between a closed position in which the tongue is aligned with the wall and and open position in which the tongue extends upwardly and outwardly from hinging means of the tongue when the slittable lines of weakening have been slit, the pour spout being closable by swinging the tongue from the open position past alignment with the wall to move the portion of the central portion of the web projecting beyond the tongue into the container and then outwardly into abutment with the inward face of the wall securing the tongue closed position flush with the wall.

19. A pour spout assembly as in claim 18 having an inner seal panel attached to the inward face of the wall annularly of the tongue and accordian pleat panels and underlying the tongue and web portions to form a minor chamber between a portion of the in-facing side of the wall and tongue and the inner seal panel.

20. A pour spout assembly as in claim 19 wherein the accordian pleat panels overlie the central web portion, one pair of accordian pleat panels extend between the other pair of accordian pleat panels and the central web portion, and the other pair of accordian pleat panels extend between the first pair of accordian pleat panels and the seal panel, the accordian pleat panels and the central web portion being adapted to confine articles enclosed in the minor chamber in desired position.

21. A pour spout assembly as in claim 20 in which the container and inner seal panel have like barrier properties providing a major chamber for isolating contents thereof from the surrounding environment and precluding escape of any part of the predetermined content of the major chamber.

22. A pour spout assembly as in claim 19 wherein the accordian pleat panels extend toward each other and between the central web portion and the seal panel, the accordian pleat panels and the central web portion being adapted to confine articles enclosed in the minor chamber in desired position.

23. A pour spout assembly as in claim 18 wherein at least one of the slits defining the tongue is incomplete and must be completed to open the pour spout to provide a visible indication that the container has been opened and the contents thereof may have been tampered with or may have been supplemented by a shoplifter whereby the purchaser and the merchant may be alerted at the time of purchase.

24. A pour spout assembly for a container having a wall which comprises a tongue formed from the wall and hinged to the wall, the tongue being defined by a transverse parting line of weakening in said wall and downwardly extending upright slittable lines of weakening in said wall at opposite ends of the transverse parting line of weakening, the tongue being hinged to the wall at lower ends of the upright slittable lines of weakening, a web member having a central portion, the central portion of the web is attached to an area of the inner face of the tongue, outer glue panels attached to an inner face of the container adjacent the tongue and accordian pleat panels connecting the central portion and the outer glue panels, free edges of the central panel of the web being hinged to the accordian pleat panels, outer edges of the accordian pleat panels being hinged to the glue panels, the tongue being wider adjacent the tongue hinge line and narrower adjacent the free end of the tongue than the attached central portion of the web, at least a portion of the central web portion spanning a portion of an upright slit and overlapping a portion of the inward face of the wall between the slit and a glue panel to resist movement of the spout from closed to open position, the tongue swinging between a closed position in which the tongue is aligned with the wall and an open position in which the tongue extends upwardly and outwardly from hinging means of the tongue when the slittable lines of weakening have been slit and determine the width and cross sectional configuration of the mouth of the spout when the tongue is fully extended, the pour spout being closable by swinging the tongue from the open position past alignment with the wall to move the portion of the central portion of the web projecting beyond the tongue into the container and then outwardly into abutment with the inward face of the wall securing the tongue in closed position flush with the wall.

25. A pour spout assembly as in claim 18 in which there is a major chamber in the container and the major chamber is spaced from the minor chamber by an inner seal panel.

26. A pour spout assembly as in claim 25 in which the inner seal panel is readily frangible to permit access to the major chamber.

27. A pour spout assembly for a container having a wall which comprises a tongue formed from the wall and hinged to the wall, the tongue being defined by a transverse parting line of weakening in said wall and downwardly extending upright slittable lines of weakening in said wall at opposite ends of the transverse parting line of weakening, the tongue being hinged to the wall at lower ends of the upright slittable lines of weakening, a web member having a central portion attached to an inner face of the tongue, outer glue panels attached to an inner face of the container adjacent the tongue and accordian pleat panels connecting the central portion and the outer glue panels, free edges of the central panel of the web being hinged to the accordian pleat panels, outer edges of the accordian pleat panels being hinged to the glue panels, and at least a portion of the central web portion spanning a portion of an upright slit and overlapping a portion of the inward face of the wall between the slit and a glue panel to resist movement of the spout from closed to open position, the tongue swinging between a closed position in which the tongue is aligned with the wall and an open position in which the tongue extends upwardly and outwardly from hinging means of the tongue when the slittable lines of weakening have been slit, the pour spout being closable by swinging the tongue from the open position past alignment with the wall to move the portion of the central portion of the web projecting beyond the tongue into the container and then outwardly into abutment with the inward face of the wall securing the tongue closed position flush with the wall and in which the central portion of the web being wider than the tongue adjacent the transverse slit and no wider than the tongue where hinged to the wall, at least a portion of the central web portion spanning a portion of an upright slit and overlapping a portion of the inward face of the wall between the slit and a glue panel to resist movement of the spout from closed to open position.

28. A pour spout assembly as in claim 27 in which a central wall glue panel portion of the web is secured to the inward face of the wall and reinforces the wall and tongue hinge.

29. A pour spout assembly as in claim 27 wherein a seal panel divides the container into major and minor chambers whereby articles enclosed in the minor chamber are isolated from the contents of the major chamber and readily accesible to the consumer upon opening of the pour spout while the major chamber remains unopened.

30. A pour spout assembly for a container having a wall which comprises a tongue formed from the wall and hinged to the wall, the tongue being defined by a transverse parting line of weakening in said wall and downwardly extending upright slittable lines of weaking in said wall at opposite ends of the transverse parting line of weakening, the tongue being hinged to the wall at lower ends of the upright slittable lines of weakening, a web member having a central portion attached to an inner face of the tongue, outer glue panels attached to an inner face of the container adjacent the tongue and accordian pleat panels connecting the central portion and the outer glue panels, free edges of the central panel of the web being hinged to the accordian pleat panels, outer edges of the accordian pleat panels being hinged to the glue panels, and at least a portion of the central web portion spanning a portion of an upright slit and overlapping a portion of the inward face of the wall between the slit and a glue panel to resist movement of the spout from closed to open position, the tongue swinging between a closed position in which the tongue is aligned with the wall and an open position in which the tongue extends upwardly and outwardly from hinging means of the tongue when the slittable lines of weakening have been slit, the pour spout being closable by swinging the tongue from the open position past alignment with the wall to move the portion of the central portion of the web projecting beyond the tongue into the container and then outwardly into abutment with the inward face of the wall securing the tongue closed position flush with the wall and in which a web seal panel overlaps the central web portion, the accordian fold portions, the glue flap portion and the inward face of the wall adjacent an end of the tongue hinge line to spanningly close and to effect a seal to preclude escape of product from the pour spout adjacent the ends of the tongue hinge line.

* * * * *